US006802306B1

(12) United States Patent
Rice

(10) Patent No.: US 6,802,306 B1
(45) Date of Patent: Oct. 12, 2004

(54) PAINT BALL LOADING AND FIRING APPARATUS

(76) Inventor: Jack V. Rice, 9006 Wimbley Ct., Elk Grove, CA (US) 95624

( * ) Notice: Subject to any disclaimer, the term of this patent is extended or adjusted under 35 U.S.C. 154(b) by 0 days.

(21) Appl. No.: 10/033,161

(22) Filed: Oct. 26, 2001

(51) Int. Cl.[7] ..... F41B 11/24

(52) U.S. Cl. ..... 124/74

(58) Field of Search ..... 124/53, 71, 72, 124/73, 74

(56) References Cited

U.S. PATENT DOCUMENTS

| | | | | | |
|---|---|---|---|---|---|
| 5,462,042 | A | * | 10/1995 | Greenwell | 124/56 |
| 5,497,758 | A | * | 3/1996 | Dobbins et al. | 124/71 |
| 5,503,137 | A | * | 4/1996 | Fusco | 124/72 |
| 5,673,679 | A | * | 10/1997 | Walters | 124/49 |
| 5,769,066 | A | * | 6/1998 | Schneider | 124/75 |
| 6,343,599 | B1 | * | 2/2002 | Perrone | 124/73 |
| 6,371,099 | B1 | * | 4/2002 | Lee | 124/58 |
| 6,520,171 | B2 | * | 2/2003 | Reible | 124/73 |
| 2002/0096164 | A1 | * | 7/2002 | Perrone | |
| 2002/0104524 | A1 | * | 8/2002 | Reible | |
| 2003/0075161 | A1 | * | 4/2003 | Fujimoto et al. | |

OTHER PUBLICATIONS

Insight Component Engineering; The Epic; "http://icepaintball.com/" internet web site; Apr. 3, 2001.

* cited by examiner

*Primary Examiner*—Jack Keith
*Assistant Examiner*—Troy Chambers
(74) *Attorney, Agent, or Firm*—Heisler & Associates

(57) ABSTRACT

A paint ball marker 10 is provided with a rapid loading and firing configuration. A compressed gas is fed to a trigger valve 30 which controls a position of a ram 40. When a trigger 24 is pulled, the trigger valve 30 directs air to the ram 40 so that a piston 44 within the ram 40 causes a unity bracket 50 to move. This unity bracket 50 controls an activator valve 60, causing a charge of compressed gas to be released from a charge chamber 80 to an entrance 91 of the firing chamber 90 where a paint ball is fired from the firing chamber 90. The unity bracket 50 also causes a loading slide 100 to activate a door 110 immediately after firing of the paint ball from the firing chamber 90 so that the door 110 is moved from a closed position to an open position. In the open position a loading hole 96 routes another paint ball into the firing chamber 90. When the unity bracket 50 returns, by further action of the ram 40 and trigger valve 30, compressed gas is allowed to recharge the charge chamber 80 and the door 110 is allowed to return to its biased closed position sealing off the firing chamber 90 with another paint ball therein for future firing. This rapid loading and firing sequence can then be repeated by again toggling the trigger 24.

29 Claims, 4 Drawing Sheets

PAINT BALL LOADING AND FIRING APPARATUS

FIELD OF THE INVENTION

The following invention relates to paint ball markers for firing paint balls with sufficient velocity to explode the paint balls against a target. More particularly, this invention relates to compressed gas fired paint ball markers which are capable of rapidly firing a large number of paint ball rounds.

BACKGROUND OF THE INVENTION

Paint ball markers have long been known for firing spherical balls loaded with a marking dye which can rupture and mark a target upon contact. Typical markers have an appearance generally similar to that of a handgun or rifle but are typically fired by compressed air rather than an explosive charge. Compressed air (or other compressed gases) are stored within the marker with the compressed air firing the paint ball out of the firing chamber when a valve is opened, typically by pulling a trigger, to cause the compressed air to flow to the firing chamber and fire the paint ball out of the firing chamber.

Rapid fire operation of the paint ball marker is often particularly desirable. While advancements have been made in the art to achieve rapid fire operation, problems with such rapid fire paint ball markers persist. These problems include excessive length of the paint ball marker to accommodate a bolt for rapidly loading paint balls into the firing chamber and excessive jamming of the mechanisms which load the paint balls into the firing chamber. Also, paint ball rupture within the firing chamber is a common problem in the prior art, requiring cleaning of the marker before further use. Such disassembly for cleaning of the firing chamber when premature paint ball rupture occurs is difficult with prior art markers. Also, excessive complexity of prior art markers leads to excessive cost and more difficult maintenance.

Accordingly, a need exists for a rapid fire paint ball marker with a loading and firing apparatus which addresses these deficiencies in the prior art.

SUMMARY OF THE INVENTION

The paint ball marker of this invention eliminates the moving bolt in line with the firing chamber for loading paint balls into the firing chamber. Paint balls are loaded directly into the firing chamber laterally by operation of a sliding door. Opening and closing of this door, along with the loading of paint balls into the firing chamber is precisely controlled in a timed fashion along with release of a firing charge of compressed gas into the firing chamber for expelling the paint ball.

Specifically, a trigger is provided for firing the marker. This trigger is coupled to a 3-way pneumatic valve. The 3-way pneumatic valve controls a position of a ram. The ram includes a piston slidably positioned within a blind bore within a housing of the marker. Movement of the trigger causes compressed gas flow to act upon the piston within the ram in one of two directions to cause the piston to move in a desired fashion. A rod extends from the piston and is coupled to a unity bracket.

The unity bracket is driven by the ram which is controlled by toggling of the trigger. The unity bracket in turn controls an activator valve which directs compressed gas to the firing chamber. The unity bracket also controls positioning of the door which selectively opens and closes a loading hole for feeding paint balls into the firing chamber.

The activator valve preferably has a generally cylindrical form with a shaft moving longitudinally within a bore. A series of ports extend between a source of compressed air, a charge chamber and an outlet port leading to an entrance for compressed gas into the firing chamber. The shaft of the activator valve is coupled to the unity bracket. Hence, when the unity bracket is driven by the ram, the shaft of the activator valve moves within the bore. Pathways within the shaft selectively allow for compressed gas flow from the source of compressed gas into the charge chamber and then later from the charge chamber to the outlet port and on to the firing chamber.

Simultaneously, the unity bracket preferably controls the door for loading paint balls into the firing chamber. The unity bracket causes a loading slide coupled thereto to move. The loading slide has a beveled end which is configured to interface with an under bevel on the door adjacent the loading hole in the firing chamber. The beveled end of the loading slide and under bevel are configured so that when they abut each other movement of the loading slide causes the door to move from the closed position to the open position. A spring biases the door to the closed position. Hence, the door remains closed except when the loading slide is driven into the under bevel of the door, causing the door to move to the open position.

A door slot adjacent the loading hole in the firing chamber restricts the door to only sliding motion along a line non-parallel with a central axis of the firing chamber. The door slot has beveled and tapered lateral edges which complement beveled and tapered rails along side edges of the door so that the door is held adjacent the loading hole when the door is in the closed position and the door can tightly seal the firing chamber when the door is in the closed position.

Movement of the activator valve and the door are synchronized so that the door is closed when the activator valve releases the charge of compressed gas to the firing chamber. When the activator valve is closed to air passing out of the firing chamber but open to air entering the charge chamber, the door is in the open position so that a paint ball can pass through the loading hole and into the firing chamber. The door is then closed before the activator valve opens to allow compressed gas from the charge chamber to the entrance into the firing chamber.

Because the paint balls move laterally into the firing chamber, rather than being brought forward in axial fashion by a bolt into the firing chamber, an overall length of the marker which would otherwise be required to accommodate the bolt is reduced. Additionally, a back plug need merely be removed to provide access entirely through the firing chamber and barrel, so that ruptured paint balls within the firing chamber can be quickly evacuated.

OBJECTS OF THE INVENTION

Accordingly, a primary object of the present invention is to provide a paint ball marker which quickly and reliably loads and fires a paint ball with a charge of compressed gas.

Another object of the present invention is to provide a compressed gas paint ball marker which does not include a bolt.

Another object of the present invention is to provide a paint ball marker which can be quickly and easily cleaned, especially through the firing chamber and barrel, such as when a paint ball ruptures.

Another object of the present invention is to provide a paint ball marker which can rapidly fire paint balls.

Another object of the present invention is to provide a paint ball marker which avoids jamming and paint ball rupture.

Another object of the present invention is to provide a paint ball marker which is of relatively simple, lightweight and reduced size overall construction.

Other further objects of the present invention will become apparent from a careful reading of the included drawing figures, the claims and detailed description of the invention.

DESCRIPTION OF THE PREFERRED EMBODIMENT

Figure 1:
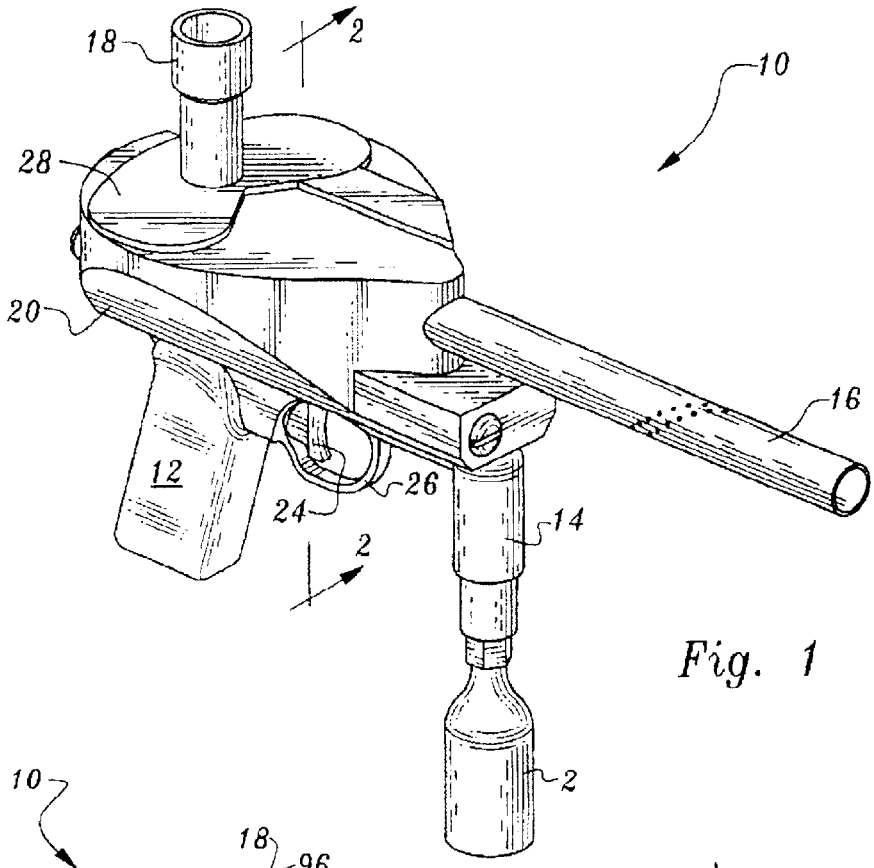
FIG. 1 is a perspective view of the paint ball marker of this invention.

Referring to the drawings, wherein like reference numerals represent like parts throughout the various drawing figures, reference numeral 10 is directed to a compressed gas fired paint ball marker (FIG. 1). The marker 10 utilizes compressed gas from a gas canister 2 so that when a trigger 24 is toggled by a user various systems within a housing 20 cause compressed gas to flow through a regulator 14 and on to a firing chamber 90 (FIG. 2) for firing of a paint ball out of a barrel 16.

Figure 2:
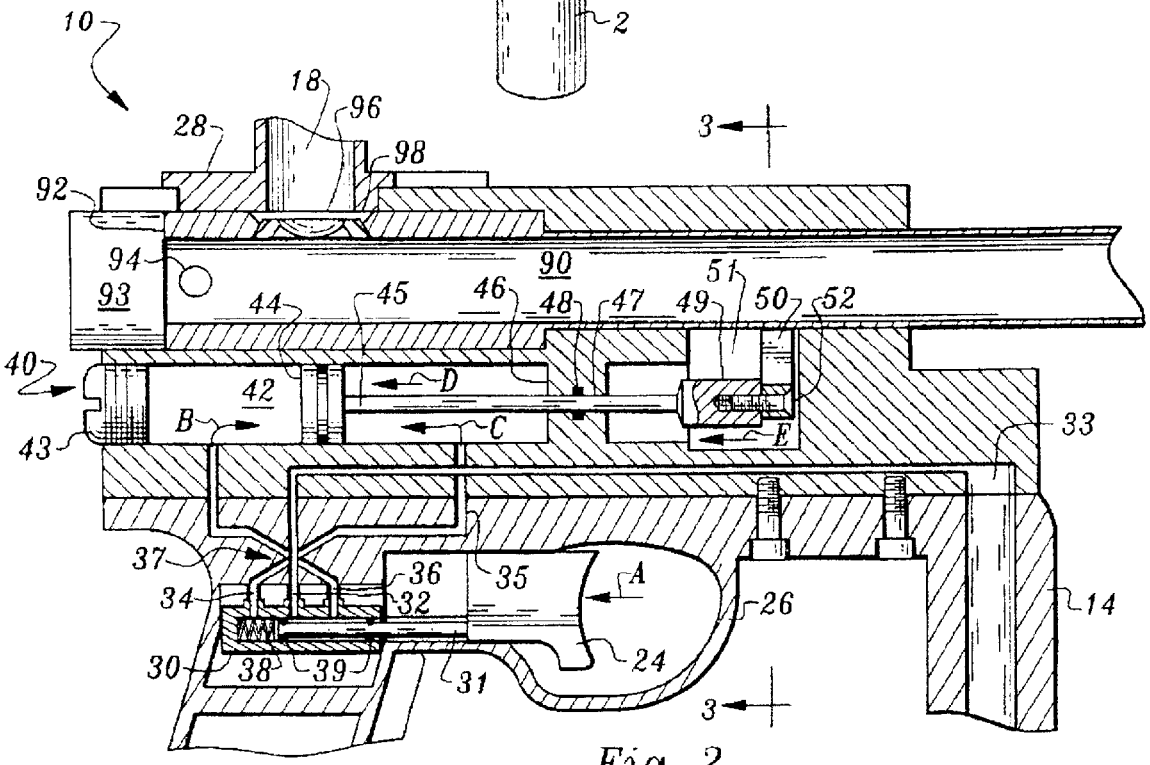
FIG. 2 is a sectional view taken along line 2—2 of FIG. 3 and particularly revealing the construction of the trigger, ram and firing chamber of the paint ball marker of this invention.

In essence, and with particular reference to FIGS. 2-6, the basic configuration of the paint ball marker 10 is described. The trigger 24 is coupled to a trigger valve 30 (FIG. 2). The trigger valve 30 is of an at least partially pneumatic type with compressed gas from the regulator 14 passing through the trigger valve 30 and then on to a ram 40. The ram 40 has a piston 44 therein whose position is controlled by the position of the trigger valve 30. The piston 44 in turn controls a position of a unity bracket 50. The unity bracket 50 has a forward position during charging (shown in FIG. 2) and a rearward position during firing and subsequent reloading.

Figure 4:
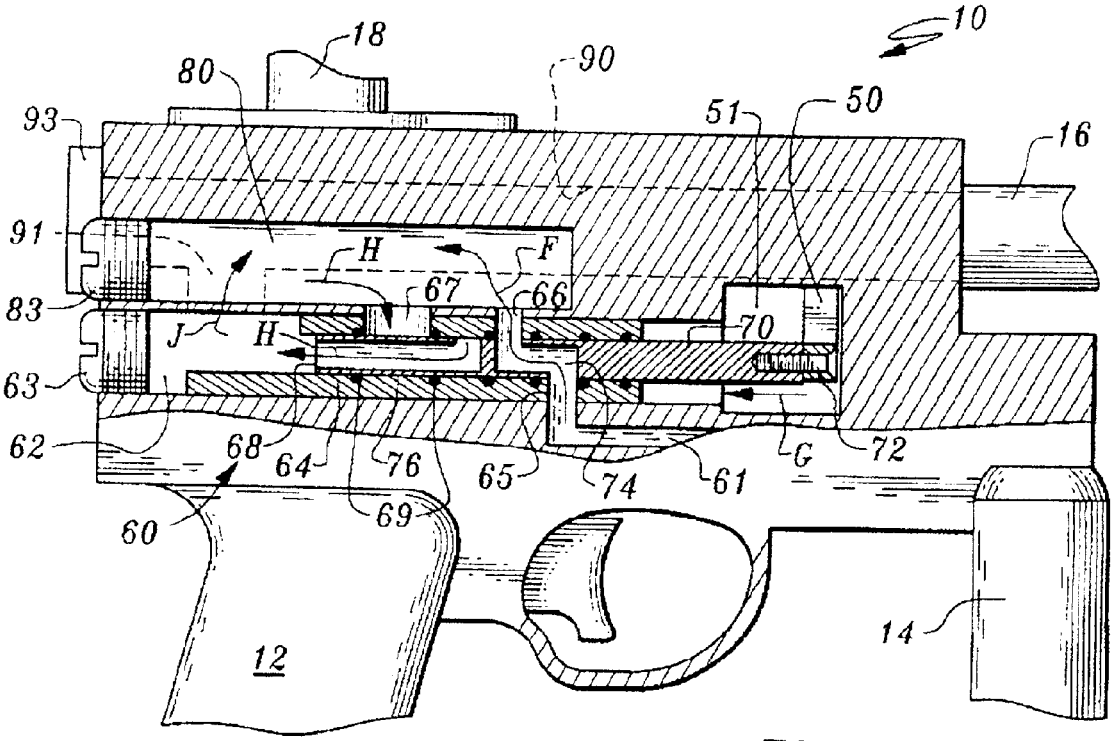
FIG. 4 is a sectional view taken along line 4—4 of FIG. 3 and particularly showing details of an actuator valve and charge chamber of this invention.

An activator valve 60 (FIG. 4) controls compressed gas flow from the regulator 14 into a charge chamber 80 and from the charge chamber 80 to the firing chamber 90 (FIG. 4). A shaft 70 is coupled to the unity bracket 50 and moves within a bore 62 of the activator valve 60 to control charging and discharging of the charge chamber 80. The unity bracket 50 is also coupled to a loading slide 100 (FIGS. 5 and 6) which acts on a door 110 to move the door between an open position (FIG. 5) and a closed position (FIG. 6). The door 110 overlies a loading hole 96 (FIG. 7) in the firing chamber 90 and is adjacent a feed tube 18 coupled to a paint ball storage magazine. When the door 110 is in its open position, a paint ball is allowed to drop down into the firing chamber 90. When the door 110 is closed, the firing chamber 90 is sealed and ready for receipt of a compressed gas charge for firing the paint ball out of the firing chamber 90 through the barrel 16.

More specifically, and with particular reference to FIG. 1, details of structures adjacent the loading and firing apparatus of this invention are described. The paint ball marker 10 includes components of the paint ball loading and firing mechanisms within a housing 20. A grip 12 is located below this housing 20 and is sized and shaped to allow a user to easily grasp the marker 10, preferably in either hand. A regulator 14 is also coupled to a lower side of the housing 20 forward of the trigger 24. The regulator 14 is configured to receive a gas canister 2 in a removable fashion at a tip of the regulator 14. The regulator 14 controls flow of compressed gas (typically compressed air) out of the gas canister 2 and into the housing 20 for use in firing the paint ball and controlling the loading and firing mechanisms of the paint ball marker 10.

A barrel 16 of any configuration known in the art or to be developed, for paint ball firing extends from a forward end of the housing 20. A feed tube 18 extends from an upper surface of the housing 20. The feed tube 18 is configured to allow paint balls to drop vertically through the feed tube 18 and into the firing chamber 90. Typically, the feed tube 18 is oriented non-horizontally.

The trigger 24 is pivotably attached to an underside of the housing 20 directly forward of the grip 12. A guard 26 is preferably located forward of and beneath the trigger 24 to decrease the possibility of accidental toggling of the trigger 24. A cap 28 is preferably provided on an upper surface of the housing 20, including the feed tube 18 thereon. The cap 28 provides access to some of the loading mechanisms within the housing 20. Additionally, the cap 28 preferably is somewhat in the form of goggles or eyes so that a view of the housing 20 from above gives the general appearance of a face. Such an appearance provided by the cap 28 is for aesthetic purposes.

With particular reference to FIG. 2, details of the trigger valve 30 and ram 40 are described. The trigger valve 30 is preferably a pneumatic 3-way valve set at a location between the grip 12 and the housing 20. The trigger valve 30 includes a pin 31 driven by the trigger 24. The trigger valve 30 includes a supply port 32 coupled to a supply line 33 which receives compressed gas from the regulator 14. The supply port 32 is preferably at a center of the trigger valve 30. A firing port 34 is preferably a rear most port on the trigger valve 30. A firing line 35 extends away from the firing port 34 and up to a forward portion of a blind bore 42 of the ram 40. A return port 36 of the trigger valve 30 is preferably a forward most port on the trigger valve 30 and is coupled to a return line 37 which extends to a rearward portion of the blind bore 42 of the ram 40.

The pin 31 is preferably positioned within a central bore in the trigger valve 30 which also includes a spring 38 biasing the pin 31 toward a forward position. When the trigger 24 is toggled, the pin 31 moves (along arrow A of FIG. 2) and the spring 38 is compressed. Seals 39 are provided which are spaced apart a distance slightly greater than a distance between the supply port 32 and the other ports 34, 36.

These seals 39 cause the supply port 32 to be in communication with the return port 36 when the trigger 24 is in a forward position and cause the supply port 32 to be in communication with the firing port 34 when the trigger 24 has been toggled (along arrow A) to a rearward position. Hence, when the trigger 24 is in a forward position compressed gas flow to the trigger valve 30 passes from the supply line 33 to the return line 37 (along arrow B of FIG. 2). When the trigger 24 has been toggled to a rear position (along arrow A) compressed gas flow occurs from the supply line 33 to the firing line 35 (along arrow C of FIG. 2).

This trigger valve 30 arrangement is merely one preferred form of trigger valve 30 configuration. The trigger valve 30 could alternatively be electropneumatic with the trigger 24 merely causing electrical contact to be made which in turn cause valves to appropriately open or close to allow compressed gas to travel to the ram 40 in the manner desired.

Figure 3:
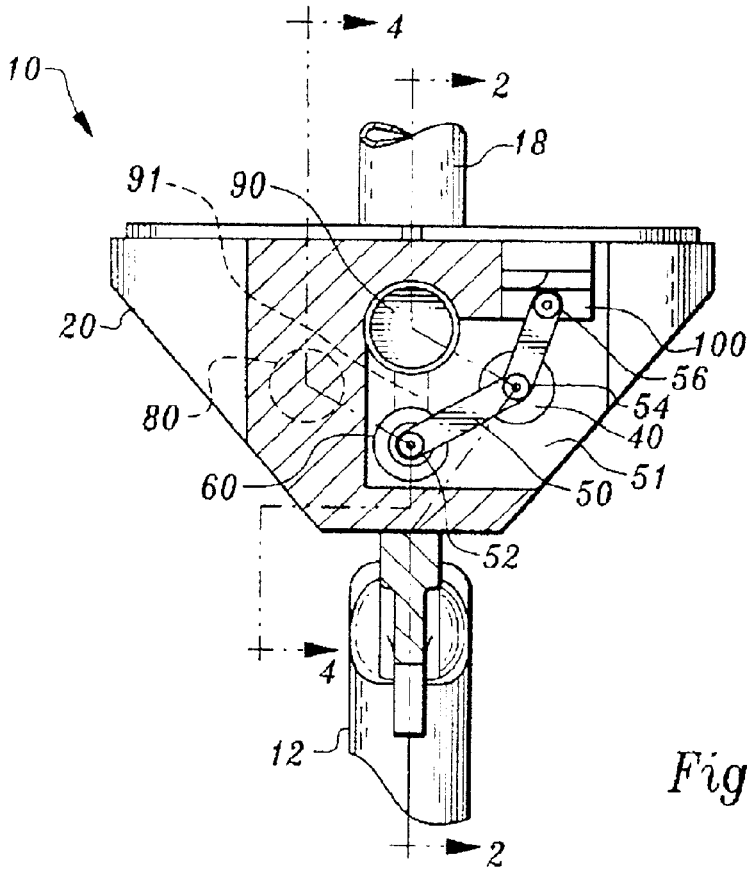
FIG. 3 is a sectional view taken along line 3—3 of FIG. 2 revealing the relative positions of the various chambers within a housing of the paint ball marker of this invention.

Note from a careful comparison of FIG. 2 and FIG. 3 that the supply line 33 is largely along a center line of the housing 20 (FIG. 3) to deliver compressed gas to the trigger valve 30 which is also along the center line of the housing 20. However, the firing line 35 and return line 37 extend up to the ram 40 which is off of the center line of the housing 20. The section line 2—2 shown on FIG. 3 jogs over appropriately to pass through the ram 40 and firing chamber 30 so that the firing line 35 and return line 37 can be shown in their entirety in FIG. 2.

Note that these lines 33, 35, 37 are required to overlap in certain locations and so would not be precisely located along the section line 2—2 of FIG. 3. For simplicity and clarity, these lines are shown as overlapping but would in fact have slightly different positions so that compressed gas flow between these lines 33, 35, 37 remain separate.

Should the type of trigger valve 30 be modified the necessity of overlapping of the lines 33, 35, 37 may disappear and other routings for lines 33, 35, 37 could be provided. However, the essential function of this trigger valve 30 remains to cause compressed air to flow to either side of the piston 44 within the ram 40 when the trigger 24 is toggled, with the details of controlling compressed gas flow into the ram 40 being potentially modifiable while still providing this basic compressed gas supply function for this invention.

The ram 40 is configured as a blind bore 42 preferably extending into the housing 20 from a rear of the housing 20 and with a plug 33 sealing off the blind bore 42. Note that the blind bore 42 of the ram 40 is located offset relative to a central plane of the housing 20, as shown in FIG. 3. In fact, the ram 40 could be located at a variety of different locations within the housing 20 with this location for the ram 40 considered to be most preferred. The blind bore 42 could be formed in other ways, potentially eliminating the need for the plug 43. For instance, the housing 20 could be made of separate pieces held together with gaskets between pieces of the housing 20.

The piston 44 is slidably supported within the blind bore 42 and includes seals, as known in the art, so that gas leakage around the piston 44 is substantially eliminated. A rod 45 is coupled to the piston 44 and extends forward from the piston 44. The rod 45 passes through an end wall 46 of the blind bore 42 along a passage 47 in the end wall 46. A seal 48 is located along this passage 47 to substantially eliminate gas flow along the passage 47. A connector 49 is attached to an end of the rod 45 opposite the piston 44, with the connector 49 coupling the rod 45 to the unity bracket 50. Compressed gas entering the blind bore 42 of the ram 40 thus drives a position of the unity bracket 50 through action of this ram assembly 40.

Specifically, before the trigger 24 is toggled, compressed gas passes along arrow B into a rearward portion of the blind bore 42, causing the piston 44 to move forward along the blind bore 42 and for the unity bracket 50 to be in a forward position within a recess 51 in which the unity bracket 50 is located. When the trigger 24 is toggled rearward (along arrow A of FIG. 2) gas flow along arrow C enters into a forward portion of the blind bore 42 of the ram 40. This compressed gas forward of the piston 44 causes the piston 44 to move rearwardly (along arrow D of FIG. 2). The rod 45 similarly moves rearwardly and drives the unity bracket 50 rearward (along arrow E of FIG. 2). When the trigger 24 is released the spring 38 returns the trigger 24 to its starting point and compressed air flow occurs (along arrow B) to a rearward portion of the blind bore 42 of the ram 40, causing the piston 44 and unity bracket 50 to return forward for completion of the cycle.

With particular reference to FIGS. 3 and 4, details of the unity bracket 50, activator valve 60 and charge chamber 80 are described. The unity bracket 50 is preferably a rigid construct with a lower junction 52 coupled to a shaft 70 of the activator valve 60, a mid junction 54 coupled to the rod 45 of the ram 40 and an upper junction 56 coupled to the loading slide 100. The unity bracket 50 moves within a recess 51 (FIGS. 2-4) with the unity bracket 50 restricted to forward and rearward movement. A bend 58 is preferably provided in the unity bracket 50 (FIG. 3) to accommodate the relative positions of the ram 40, activator valve 60 and loading slide 100.

The activator valve 60 generally provides the function of selectively opening and closing appropriate ports to deliver a charge of compressed gas to an entrance 91 (FIG. 4) of the firing chamber 90. In one form, the activator valve 60 is configured as shown in FIG. 4. Specifically, a supply path 61 leads from the regulator 14 to a bore 62 extending into the housing 20 from a rear of the housing 20 and preferably along a center line of the housing 20 and below the firing chamber 90 and barrel 16 of the paint ball marker 10. A plug 63 is provided to seal the bore 62. As with the blind bore 42 of the ram 40, if alternative manufacturing techniques are used, the plug 63 may be eliminated.

Preferably, a sleeve 64 is inserted into the bore 62 with seats for seals/O-rings and appropriate ports extending radially through the sleeve 64 and out of the bore 62 at various locations along the bore 62.

Specifically, an inlet port 65 passes through the sleeve 64 and into the bore 62 which allows compressed gas traveling along the supply path 61 to pass into the bore 62. A charge port 66 extends from the bore 62 into the charge chamber 80 where a charge of compressed gas can collect before use in firing a paint ball from the firing chamber 90. The charge chamber 80 is preferably cylindrical for ease in manufacturing by boring a hole into a rear of the housing 20 and closure with a plug 83. A discharge port 67 extends from the charge chamber 80 back to the bore 62 of the activator valve 60. An outlet port 68 preferably in the form of an end of the bore 62 and sleeve 64 adjacent the plug 63 is provided for routing the charge of compressed gas out of the charge chamber 80 and on toward the entrance 91 of the firing chamber 90. Seals 69 are located adjacent the various different ports passing through the bore 62 and sleeve 64.

The shaft 70 of the activator valve 60 is attached to the unity bracket 50 through a coupler 72 so that the shaft 70 moves with the unity bracket 50. The shaft 70 has pathways therein which can align with ports in the sleeve 64 and bore 62 at appropriate times to allow compressed gas to pass from the supply path 61 to the charge chamber 80 and from the charge chamber 80 to the entrance 91 of the firing chamber 90. Specifically, a charge pathway 74 is provided on a forward portion of the shaft 70 which can provide alignment between the inlet port 65 and the charge port 66. A discharge pathway 76 is provided within the shaft 70 which provides communication between the discharge port 67 and the outlet port 68.

The charge pathway 74 and discharge pathway 76 are spaced from each other an appropriate distance so that the charge port 66 is opened at precisely the right time with the overall sequence of loading and firing of the firing chamber 90 so that the charge of compressed gas is delivered to the entrance 91 of the firing chamber 90 at the correct time for firing of the paint ball out of the firing chamber 90. Specifically, when the unity bracket 50 is in a forward position the charge pathway 74 is open to the inlet port 65 and the charge port 66 so that corn pressed gas can flow (along arrow F of FIG. 4) from the regulator 14, along the supply path 61, through the charge pathway 74 and into the charge chamber 80. When the unity bracket 50 begins to move rearward (along arrow G of FIG. 4), due to motion of the piston 44 within the ram 40 (FIG. 2), the charge pathway 74 of the shaft 40 closes. After the charge pathway 74 has been totally closed the discharge pathway 76 begins to move into alignment with the discharge port 67. The charge of compressed gas which has been collected within the charge chamber 80 is then allowed to exit (along arrow H of FIG. 4) through the discharge port 67, through the discharge pathway 76 and out the outlet port 68 at the end of the shaft 70.

The outlet port 68 leads to an end of the blind bore 62 adjacent the plug 63 which is in direct communication with the firing chamber 90 through the entrance 91 passing between the firing chamber 90 and the bore 62 of the activator valve 60. Hence, this compressed gas charge exiting the outlet port 68 can be routed (along arrow J of FIG. 4) to the entrance 91 and up into the firing chamber 90. This compressed gas charge then acts on the paint ball within the firing chamber 90 to shoot the paint ball out the barrel 16 of the paint ball marker 10.

As the ram 40 continues to cycle, the unity bracket 50 again moves forward, causing the shaft 70 of the activator valve 60 to also move forward. Eventually the charge pathway 74 is again open to allow compressed gas to enter the charge chamber 80 for a repeat of the firing cycle.

The activator valve 60 shown in FIG. 4 is merely one form of valve to allow compressed gas to be fed from the regulator 14 to the entrance 91 of the firing chamber 90. Numerous alternatives could also be utilized. For instance, it is not strictly necessary that a separate charge port 66 and discharge port 67 pass between the bore 62 and the charge chamber 80. Rather, a single port could be provided which would act as both the charge port 66 and discharge port 67. In one form, the activator valve 60 could be configured similarly to the trigger valve 30 as a basic 3-way valve with compressed gas first being led into the charge chamber first by the 3-way valve and second being led out of the charge chamber and on to the firing chamber 90 by such a 3-way valve.

Note that the various different ports of the activator valve 60 are not aligned within a single plane, as best shown in FIGS. 3 and 4. Rather, the various ports of the activator valve 60 are oriented at a location which allows compressed gas to flow between the regulator and the activator valve 60, between the activator valve 60 and the charge chamber 80, and between the activator valve 60 and the entrance 91 of the firing chamber 90.

Figure 5:
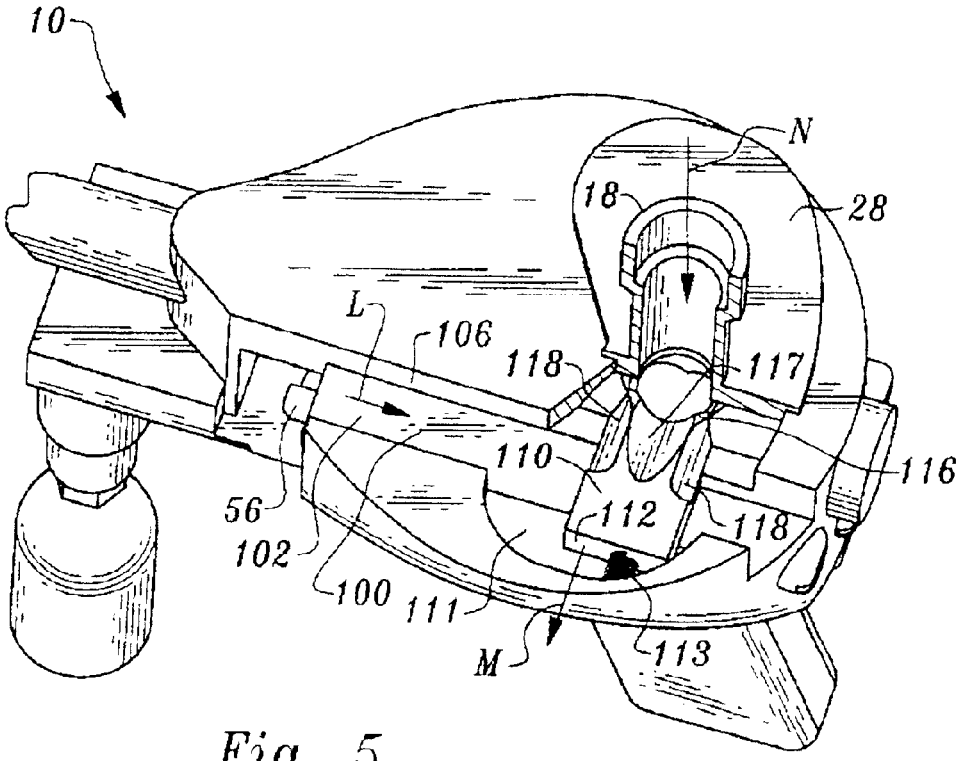
FIG. 5 is a perspective view of this invention with portions cut away and particularly revealing action of a loading slide and door of this invention with the door in an open position for paint balls to pass into the firing chamber of this invention.
Figure 6:
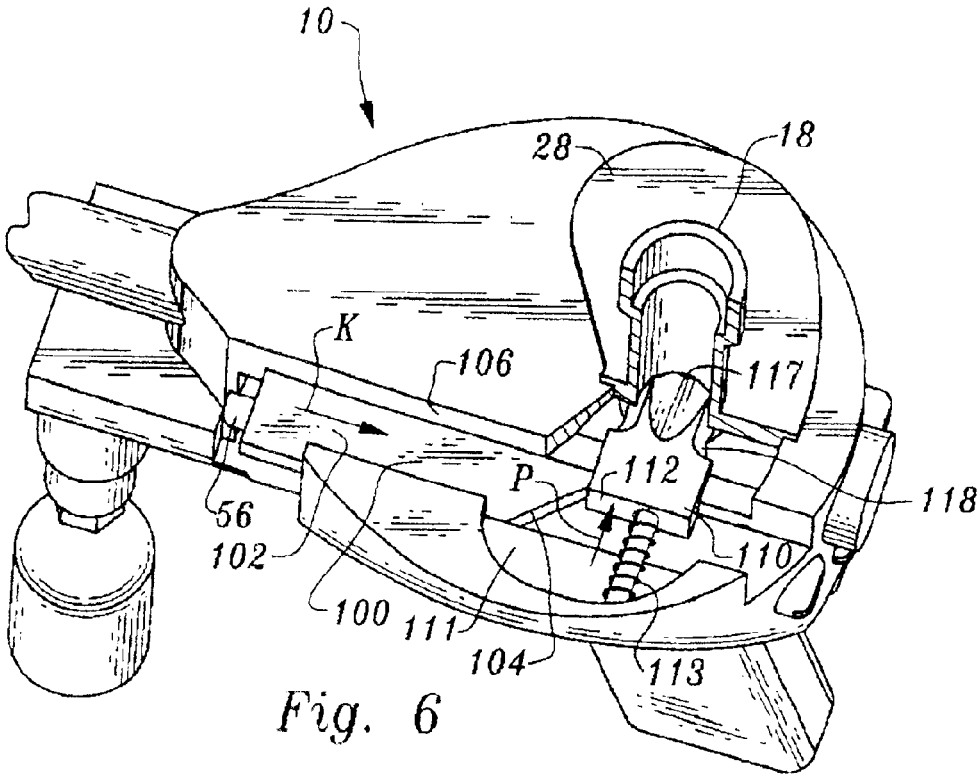
FIG. 6 is a perspective similar to that which is shown in FIG. 5 but with the door shown in a closed position.
Figure 7:
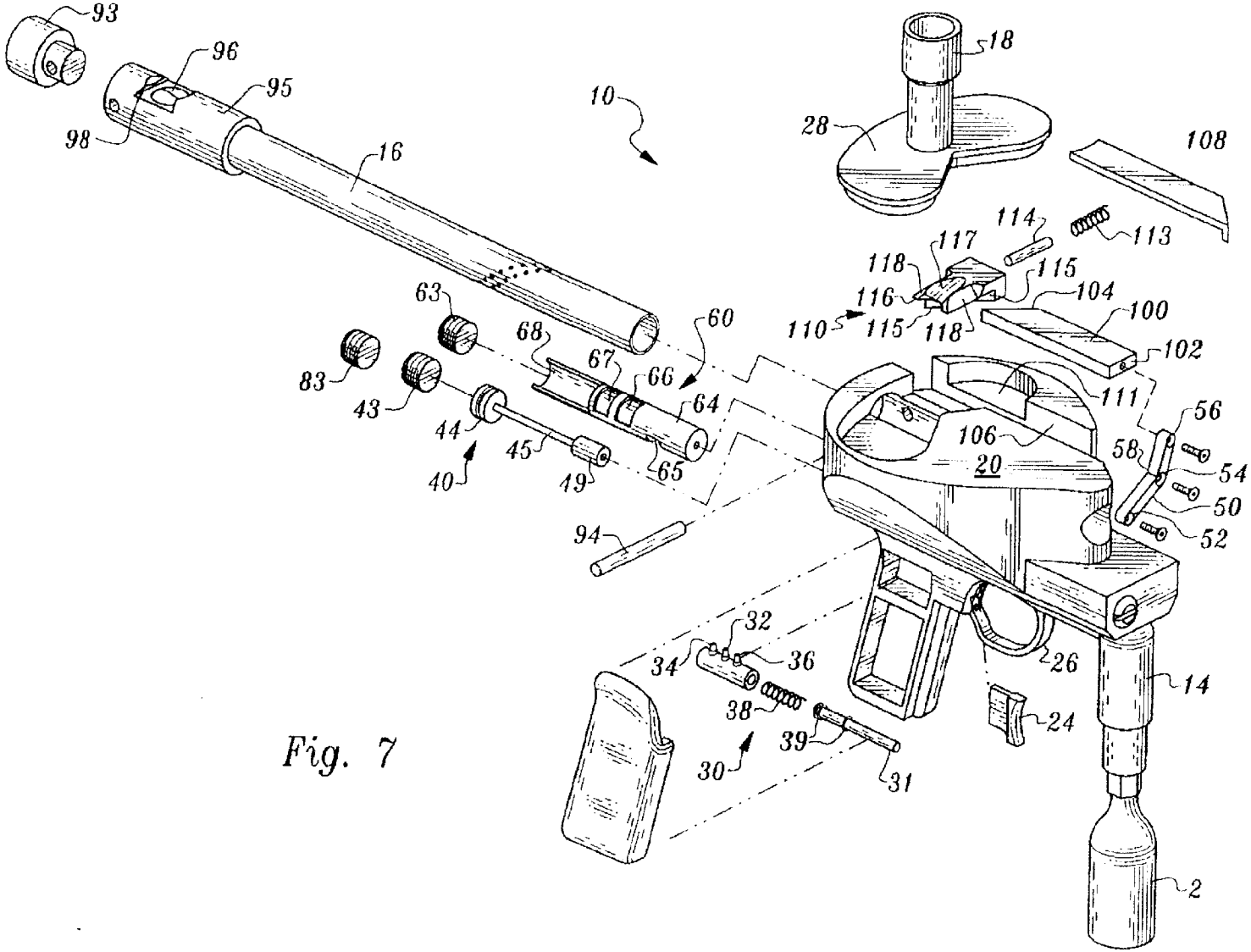
FIG. 7 is a perspective exploded parts view of that which is shown in FIG. 1, revealing the various different structures of the paint ball marker of this invention separate from a housing in which the various different components reside.

With particular reference to FIGS. 5-7, details of the loading system of this invention are particularly described. The firing chamber 90 is preferably configured as a hollow cylindrical recess with an entrance 91 extending up into the firing chamber 90 from the activator valve 60, with a rear end 92 blocked by a back plug 93, held in place by holding pin 94, and with a loading hole 96 passing through an upper portion of the cylindrical wall of the firing chamber 90 slightly forward of the entrance 91 and communicating with the feed tube 18.

A cylindrical liner 95 increases the wall thickness of the firing chamber 90 and distinguishes the firing chamber 90 from the barrel 16 extending from an end of the firing chamber 90 opposite the rear end 92. Preferably, an interior diameter of the firing chamber remains the same both within the firing chamber 90 and within the barrel 16. This diameter is preferably approximately the same as the diameter of a paint ball to be fired out of the firing chamber 90.

The back plug 93 is particularly configured to be quickly and easily removed and replaced on a rear end 92 of the firing chamber 90. The back plug 93 does not move during loading of the firing chamber 90. Rather, the back plug 93 is only removed when cleaning of the firing chamber 90 and barrel 16 is required, such as when a paint ball ruptures within the firing chamber 90 or barrel 16. The back plug 93 includes a hole which can receive the holding pin 94 (FIG. 7) therein with the holding pin 94 being quickly removable from the hole in the back plug 93 so that the back plug 93 can be quickly removed and quickly replaced when desired.

The loading hole 96 into the firing chamber 90 preferably has a circular contour similar in size to a paint ball so that a paint ball can pass through the loading hole 96 and into the firing chamber 90. A door slot 98 (FIG. 7) surrounds the loading hole 96 and provides beveled side surfaces to retain the door 110 and allow the door 110 to slide between an open position exposing the loading hole 96 and a closed position covering the loading hole 96.

The upper junction 56 of the unity bracket 50 is coupled to an attached end 102 of the loading slide 100. Thus, the loading slide 100 moves with the unity bracket 50 and the ram 40. The loading slide 100 includes a beveled end 104 opposite the attached end 102. The loading slide 100 resides within a slide slot 106 which is preferably parallel to a central axis of the firing chamber 90 and directly forward of the door 110. A cover 108 covers the slide slot 106 and allows the loading slide 100 to slide within a substantially closed recess of rectangular cross-section.

The loading slide 100 has a length between the attached end 102 and the beveled end 104 which is less than a distance between the unity bracket 50 and the door 110. Hence, the unity bracket 50 can move somewhat (along arrow G of FIG. 4) before the beveled end 104 of the loading slide 100 comes into contact with the door 110. Preferably, this delay in having the loading slide 100 contact the door 110 is sufficient that the activator valve 60 has already delivered the compressed gas charge to the firing chamber 90 and the paint ball fired before the beveled end 104 of the loading slide 100 contacts the door 110. The beveled end 104 of the loading slide 100 passes under portions of the door 110 and abuts against an under bevel 115 on an underside of the door 110. The door 110 resides within a recess 111 and an upper portion of the housing 20. The door 110 includes a base end 112 with a spring 113 interposed between the base end 112 and a side wall of the recess 111. A post 114 preferably keeps the spring 113 aligned with the base end 112. The spring 113 biases the door 110 towards a closed position (FIG. 6) by pushing on the base end 112 of the door 110.

When the beveled end 104 of the loading slide 100 moves sufficiently (along arrow L of FIG. 5) to abut the under bevel 115 of the door 110, the beveled end 104 of the loading slide 100 pushes on the under bevel 115 of the door 110 and causes the door 110 to move laterally (along arrow M of FIG. 5) into the open position.

FIG. 6 shows the loading slide 100 after it has moved approximately half of its total travel and is just beginning to impact the under bevel 115 of the door 110 (arrow K of FIG. 6). At this moment the spring 113 is still exerting a force on the door 110 (along arrow P) sufficient to keep the door 110 in the closed position. As the loading slide 100 continues to move towards the door 110 (arrow L of FIG. 5), the beveled end 104 of the loading slide 100 acts on the under bevel 115 of the door 110 to move the door 110 (along arrow M of FIG. 5) to the open position.

A paint ball can then fall (along arrow N of FIG. 5) through the feed tube 118 and through the loading hole 96 (FIG. 7) into the firing chamber 90. When the ram 40 causes the unity bracket 50 to return forward, the loading slide 100 returns forward allowing the door 110 to move back into its closed position (along arrow P of FIG. 6) by action of the spring 113. The door 110 is thus closed with a paint ball loaded within the firing chamber 90 and ready for release.

The door 110 includes a tip 116 opposite the base end 112 (FIG. 7). A concave depression 117 is formed in a top surface of the door 110. The concave depression 117 has a greater depth adjacent the tip 116 and gradually disappears before extending to the base end 112. The concave depression 117 preferably has a curvature similar to a radius of curvature of the paint balls. The concave depression 117 helps guide a paint ball adjacent thereto down into the firing chamber 90 through the loading hole 96.

A pair of rails 118 (FIG. 7) define lateral edges of the door 110 extending towards the tip 116. These rails 118 are beveled complementally with beveled surfaces of the door slot 98 (FIG. 7) in the cylindrical liner 95 of the firing chamber 90. The rails 118 are also tapered complementally with a taper in the lateral sides of the door slot 98. Beveling of the rails 118 and the lateral sides of the door slot 98 help to hold the door 110 tightly adjacent the loading hole 96 and the firing chamber 90 so that gas cannot leak out of the loading hole 96 and past the door 110. This beveling also restricts the door 110 to lateral sliding motion in a non-parallel fashion (preferably perpendicular) relative to a central axis of the firing chamber 90.

Tapering of the rails 118 and the lateral sides of the door slot 98 cause the door 110 to be wedged tightly into the door slot 98 overlying the loading hole 96 when in the closed position. This wedging action further ensures that a tight seal is provided around the loading hole 96 of the firing chamber 90. Such tapering also decreases somewhat the degree of tolerances which must be maintained in manufacturing the door 110 and still maintaining a tight seal over the loading hole 96.

Preferably, the door slot 98 is sufficiently deep into the cylindrical liner 95 of the firing chamber 90 so that an under surface of the door 110 overlying the loading hole 96 extends slightly down into the firing chamber 90. This slight extension of the undersurface of the door 110 into the firing chamber 90 preferably is sufficient so that a distance between the closed door and a surface of the firing chamber opposite the closed door is slightly less than a diameter of the paint ball. In this way, the door 110 pinches the paint ball within the firing chamber 90 so that the paint ball cannot fall out of the barrel 16 before the charge of compressed air passes through the entrance 91 for firing the paint ball out of the firing chamber 90.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. A paint ball loading and firing apparatus comprising in combination:

a source of compressed gas;

an elongate firing chamber having a barrel at a first end for release of a fired paint ball and a removable back plug at a second rear end opposite said first end, said second rear end adapted to be at least partially open to an exterior of the apparatus and open to said first end along a substantially linear path when said back plug is removed;

a paint ball loading hole in said firing chamber, said loading hole located between said back plug and said barrel; and a selectively openable gas path between said source of compressed gas and said firing chamber.

2. The apparatus of claim 1 wherein a door is located adjacent said loading hole, said door having an open position with said loading hole exposed to allow a paint ball to pass into said firing chamber and a closed position with said door blocking passage of paint balls into said firing chamber.

3. The apparatus of claim 2 wherein said door is controlled so that said door is restricted to said closed position when said selectively openable gas path is opened and compressed gas enters said firing chamber.

4. A paint ball loading and firing apparatus comprising in combination:

a source of compressed gas;

an elongate firing chamber having a barrel at a first end for release of a fired paint ball and a removable back plug at a second end opposite said first end;

a paint ball loading hole in said firing chamber, said loading hole located between said back plug and said barrel;

a selectively openable gas path between said source of compressed gas and said firing chamber;

wherein a door is located adjacent said loading hole, said door having an open position with said loading hole exposed to allow a paint ball to pass into said firing chamber and a closed position with said door blocking passage of paint balls into said firing chamber;

wherein said door is controlled so that said door is restricted to said closed position when said selectively openable gas path is opened and compressed gas enters said firing chamber;

wherein said door slides between said open position and said closed position within a door slot, said door slot restricting said door to sliding motion between said open position and said closed position; and wherein said door has beveled rails along lateral edges thereof and wherein said door slot of said loading hole has beveled surfaces, said beveled surfaces of said door slot spaced apart a similar distance from each other as said rails of said door are spaced from each other, with said rails beveled in a direction keeping said door adjacent said firing chamber.

5. A paint ball loading and firing apparatus comprising in combination:

a source of compressed gas;

an elongate firing chamber having a barrel at a first end for release of a fired paint ball and a removable back plug at a second end opposite said first end;

a paint ball loading hole in said firing chamber, said loading hole located between said back plug and said barrel;

a selectively openable gas path between said source of compressed gas and said firing chamber;

wherein a door is located adjacent said loading hole, said door having an open position with said loading hole exposed to allow a paint ball to pass into said firing chamber and a closed position with said door blocking passage of paint balls into said firing chamber;

wherein said door is controlled so that said door is restricted to said closed position when said selectively openable gas path is opened and compressed gas enters said firing chamber;

wherein said door slides between said open position and said closed position within a door slot, said door slot restricting said door to sliding motion between said open position and said closed position;

wherein said door has a base end most distant from said firing chamber and a tip opposite said base end, said door having a width which tapers toward said tip; and wherein said door slot of said loading hole tapers to a lesser width at a side of said door slot most distant from said base end of said door.

6. The apparatus of claim 5 wherein said door includes an under bevel on a surface of said door adjacent said base end, said under bevel angling such that when a force is applied to said under bevel in a direction non-parallel with a direction of said door, said door is caused to move from said closed position to said open position.

7. The apparatus of claim 5 wherein at least one spring is interposed between said base end of said door and a portion of a housing in fixed position relative to said firing chamber, said spring biasing said door toward said closed position.

8. The apparatus of claim 6 wherein said door has a top surface opposite said under bevel with a concave depression therein, said concave depression increasing in depth as said concave depression extends toward said tip, a radius of curvature of said concave depression similar to a curvature of a paint ball.

9. The apparatus of claim 2 wherein a trigger is provided which is manually toggleable by a user, said trigger configured to move a unity bracket controlling flow of compressed gas along said gas path and controlling movement of said door between said open position and said closed position.

10. A paint ball loading and firing apparatus comprising in combination:

a source of compressed gas;

an elongate firing chamber having a barrel at a first end for release of a fired paint ball and a removable back plug at a second end opposite said first end;

a paint ball loading hole in said firing chamber, said loading hole located between said back plug and said barrel;

a selectively openable gas path between said source of compressed gas and said firing chamber;

wherein a door is located adjacent said loading hole, said door having an open position with said loading hole exposed to allow a paint ball to pass into said firing chamber and a closed position with said door blocking passage of paint balls into said firing chamber;

wherein a trigger is provided which is manually toggleable by a user, said trigger configured to move a unity bracket controlling flow of compressed gas along said gas path and controlling movement of said door between said open position and said closed position; and wherein said trigger manually adjusts flow of compressed air through a 3-way valve with compressed air flow from said 3-way valve controlling a position of a ram including a piston traveling within a cylindrical blind bore, said piston of said ram coupled to said unity bracket for control of a position of said door and gas flow along said gas path.

11. The apparatus of claim 2 wherein a charge chamber is located along said gas path, said charge chamber having at least one selectively closable opening, said charge chamber having a volume sufficient to store an amount of compressed gas sufficient to fire a paint ball out of said firing chamber.

12. The apparatus of claim 1 wherein said selectively openable gas path includes an activator including at least one valve thereon having an open position and a closed position, said activator having a position controlled by a manually actuatable trigger.

13. A paint ball marker, comprising in combination:

a grip;

a trigger;

a compressed gas source;

a firing chamber, said firing chamber being hollow along a substantially linear path between a back plug and a barrel through which a paint ball is fired;

a gas path extending between said compressed gas source and an entrance into said firing chamber, said gas path including at least one valve thereon, said valve at least partially controlled by said trigger;

a loading hole in said firing chamber forward of said back plug, said loading hole passing laterally into said firing chamber, said loading hole at least as large as a paint ball to be fired out of said firing chamber; and said firing chamber adapted to be at least partially open to an exterior of the marker, other than through the barrel, when said back plug is removed.

14. A paint ball marker, comprising in combination:

a grip;

a trigger;

a compressed gas source;

a firing chamber, said firing chamber being hollow between a back plug and a barrel through which a paint ball is fired;

a gas path extending between said compressed gas source and an entrance into said firing chamber, said gas path including at least one valve thereon, said valve at least partially controlled by said trigger;

a loading hole in said firing chamber forward of said back plug, said loading hole passing laterally into said firing chamber, said loading hole at least as large as a paint ball to be fired out of said firing chamber; and wherein said valve in said gas path is an activator valve driven by a ram having a piston residing within a blind bore, said blind bore having air pathways on either side of said piston leading to a 3-way valve coupled to said trigger, with said trigger movable to move said ram piston and said activator valve.

15. The marker of claim 13 wherein a charge chamber is located along said gas path, said charge chamber having at least one port for accessing said charge chamber, said at least one port selectively openable and closable such that a charge of compressed air can be stored within said charge chamber, said charge chamber having sufficient size to contain a charge of compressed gas sufficient to fire the paint ball out of said firing chamber.

16. The marker of claim 15 wherein an activator valve is provided which selectively charges and discharges said charge chamber, said activator valve controlled by movement of said trigger.

17. The marker of claim 13 wherein a door is located adjacent said loading hole, said door having an open position and a closed position.

18. The marker of claim 17 wherein said marker includes a ram within a cylindrical blind bore having a piston slidably located therein, said piston controlled by compressed gas from said compressed gas source selectively supplied to said blind bore by movement of said trigger, said piston coupled to a rod which is arranged to control movement of said door between said open position and said closed position.

19. A paint ball marker, comprising in combination:

a grip;

a trigger;

a compressed gas source;

a firing chamber, said firing chamber being hollow between a back plug and a barrel through which a paint ball is fired;

a gas path extending between said compressed gas source and an entrance into said firing chamber, said gas path including at least one valve thereon, said valve at least partially controlled by said trigger;

a loading hole in said firing chamber forward of said back plug, said loading hole passing laterally into said firing chamber, said loading hole at least as large as a paint ball to be fired out of said firing chamber;

wherein a door is located adjacent said loading hole, said door having an open position and a closed position;

wherein said marker includes a ram within a cylindrical blind bore having a piston slidably located therein, said piston controlled by compressed gas from said compressed gas source selectively supplied to said blind bore by movement of said trigger, said piston coupled to a rod which is arranged to control movement of said door between said open position and said closed position; and wherein said door includes a beveled surface, said door located within a door slot formed in said firing chamber adjacent said loading hole, said door slot shaped and sized to accommodate sliding of said door between said open position and said closed position, a loading slide having a beveled end which resides within a slide slot non-parallel with said door slot and adjacent said door, said beveled end having a slope which co-acts with said bevel led surface of said door when said beveled end of said loading slide abuts said bevel led surface of said door to cause said door to move from said closed position to said open position, said loading slide coupled to a unity bracket, said unity bracket also coupled to said rod of said ram, such that said loading slide is caused to move when said rod is caused to move by said trigger.

20. A paint ball loading and firing system, comprising in combination:

a cylindrical firing chamber having a closed end and an open end;

a loading hole in a cylindrical wall of said firing chamber for passage of a paint ball into said firing chamber;

a compressed air entrance into said firing chamber, said compressed air entrance located between said loading hole and said closed end;

wherein a door is provided adjacent said loading hole, said door restricted to sliding motion relative to said loading hole in a direction non-parallel with a central axis of said firing chamber;

wherein a paint ball feed tube is located on a side of said door opposite said loading hole when said door is in said closed position;

wherein said door is held tight against said cylindrical wall of said firing chamber adjacent said loading hole when said door is in said closed position; and wherein said cylindrical wall includes a door slot adjacent said loading hole which is beveled along lateral sides of said door slot, said door having rails along sides thereof which are beveled complementally with beveled lateral sides of said door slot, such that said door slot holds said door against movement away from said central axis of said firing chamber.

21. The system of claim 20 wherein said lateral side edges of said door slot are tapered and said rails of said door are tapered toward a tip of said door which travels the furthest along said door slot, said rails of said door tapering complementally with said door slot such that said door seals tightly against said door slot and said loading hole when said door is in said closed position.

22. The system of claim 20 wherein said door slot and said loading hole are sufficiently close to said central axis of said firing chamber that said door extends slightly into said firing chamber when said door is in said closed position, said door extending sufficiently into said firing chamber to pinch a paint ball between said door and said cylindrical wall of said firing chamber at a location opposite said door, such that said paint ball is retained from falling out of said open end of said firing chamber when said open end of said firing chamber is oriented below said closed end of said firing chamber.

23. A paint ball loading and firing system, comprising in combination:

a cylindrical firing chamber having a closed end and an open end with an open substantially linear path between said closed end and said open end;

a loading hole in a cylindrical wall of said firing chamber for passage of a paint ball into said firing chamber;

a compressed air entrance into said firing chamber, said compressed air entrance located between said loading hole and said closed end; and said closed end having a removable back plug adjacent thereto, causing said closed end to be closed, said closed end adapted to be at least partially open to an exterior of the firing chamber when said back plug is removed.

24. The system of claim 23 wherein a diameter of said firing chamber is approximately equal to a diameter of a paint ball to be fired out of said firing chamber.

25. The system of claim 23 wherein a door is provided adjacent said loading hole, said door restricted to sliding motion relative to said loading hole in a direction non-parallel with a central axis of said firing chamber.

26. The system of claim 25 wherein a paint ball feed tube is located on a side of said door opposite said loading hole when said door is in said closed position.

27. The system of claim 26 wherein said door is held tight against said cylindrical wall of said firing chamber adjacent said loading hole when said door is in said closed position.

28. The system of claim 23 wherein said cylindrical firing chamber is entirely open through said open end and through said closed end when said back plug is removed.

29. The system of claim 28 wherein said cylindrical firing chamber has a diameter substantially equal to a diameter of said closed end when said back plug is removed, with a center line of said firing chamber sufficiently aligned with a center of said closed end to allow a cleaning tool to pass substantially along said center line through said closed end and into said firing chamber when said back plug is removed.

* * * * *